United States Patent [19]

Julian et al.

[11] Patent Number: 4,993,570

[45] Date of Patent: Feb. 19, 1991

[54] TAMPER INDICATING CONTAINER-CLOSURE PACKAGE

[75] Inventors: Randall K. Julian, Evansville, Ind.; J. Wayne Halfacre, Iuka, Ill.

[73] Assignee: Sunbeam Plastics Corporation, Evansville, Ind.

[21] Appl. No.: 435,617

[22] Filed: Nov. 13, 1989

[51] Int. Cl.[5] ..... B65D 41/34

[52] U.S. Cl. ..... 215/252; 215/32

[58] Field of Search ..... 215/252, 253, 216, 217, 215/218, 220, 32

[56] References Cited

U.S. PATENT DOCUMENTS

| | | | |
|---|---|---|---|
| 2,153,426 | 12/1933 | McNamara et al. | 215/252 |
| 3,945,525 | 3/1976 | Jones | 215/32 |
| 4,081,097 | 3/1978 | Dold | 215/252 |
| 4,534,479 | 8/1985 | Conti | 215/252 |
| 4,548,329 | 10/1985 | Curry | 215/252 |
| 4,852,751 | 8/1989 | Halfacre | 215/32 |

*Primary Examiner*—Stephen Marcus
*Assistant Examiner*—Stephen Cronin
*Attorney, Agent, or Firm*—Gifford, Groh, Sprinkle, Patmore and Anderson

[57] ABSTRACT

A tamper indicating container and container-closure package in which the tamper indicating band is integrally molded on the container neck with connecting frangible webs. The tamper indicating band has circumferentially spaced pawls on its top which co-act with a circumferential array of ratchet teeth at the lower end of the closure cap skirt to prevent removal of the cap upon application of opening torque without fracture of the frangible webs indicating tampering or initial opening. The closure of the container-closure package includes a cap skirt having a wall portion which recesses the cap ratchet teeth and overlaps the tamper indicating band of the container so as to keep the ratchet locking mechanism out of the view of a person endeavoring to tamper with the package.

19 Claims, 2 Drawing Sheets

TAMPER INDICATING CONTAINER-CLOSURE PACKAGE

This invention relates to tamper indicating container-closure packages, and, more particularly, it relates to packages where the tamper indicator is molded integrally with the container.

A variety of tamper indicating container-closure packages are available which have been designed to indicate to a prospective purchaser if the original package has been tampered, or an attempt has been made to open the package. Most of these packages rely upon a fracture or the removal of a portion of the closure to provide such indication. A fewer number of packages rely upon a permanent change of the appearance of the closure effected by an initial opening movement without the fracture or a removal of a portion of the closure. Most of the foregoing packages rely upon a co-action between the closure and a stop or lug on the container neck to produce the fracture or other change in appearance.

A popular tamper indicating closure utilizes a tamper indicating band which is connected to the bottom of the cap skirt by a frangible connection. The frangible connection usually takes the form of a number of evenly spaced frangible webs extending between the bottom of the cap skirt and the top of the band. The band usually has an inwardly directed bead at its bottom which cooperates with a stop in the form of a flange or undercut on the container neck. This cap bead and container flange, commonly known as a snap bead connection, prevents the band from moving axially when the cap is turned in an unthreading direction. This causes the frangible webs to break in tension upon initial opening movement of the cap. The band normally remains with the container neck after fracture indicating the prior opening or tampering of the package. With this type of package, the often considerable axial movement required to fracture the frangible webs opens the seal between the closure and container so that leakage or possible access is obtainable to the contents of the container prior to fracture of the tamper indicating band. A variation of this closure which overcomes this pre-indicating leakage or tampering access problem is to provide ratchet teeth on the bottom of the tamper indicating band which co-act with stops or ratchet teeth on the container neck which prevent rotation of the band during the initial unthreading of the cap, causing failure of the frangible webs in shear or torsion.

Where the tamper indicating deformation or fracture occurs on the closure, there is always a possibility of failure of the frangible connection during the capping operation during which the closure cap is initially affixed to the container neck. It is, therefore, a principal objective of this invention to mold the tamper indicating feature of the closure integrally with the container neck. This allows the use of standard types of closures with little or no possibility of failure of the frangible webs during application of the closure to the container neck. Likewise, the problem of breaking the seal between the closure cap and the container neck prior to the failure of the tamper indicating feature is eliminated by the use of an improved ratchet connection between the closure and container neck.

The tamper indicating container-closure package of this invention includes a container having a neck with closure attaching means. The closure attaching means usually takes the form of threads which requires the closure to be rotated for its removal from the container neck. A conventional helical thread extending around the container neck and closure cap of more than 360° requires the cap to be threaded on and to be threaded off. With the use of multiple start threads or jump threads on the container neck and closure cap, the cap can be applied by a single axial movement of the closure relative to the container neck by the capping machine, and opening can be achieved with less than 360° rotation. These multiple start threads can take the form of bayonet connections wherein inwardly extending lugs on the cap engage recesses in ramps on the container neck.

The container has an outwardly extending flange on the neck below the threads which supports a tamper indicating band which circumposes the neck and is attached to the flange by a number of circumferentially spaced frangible webs. A number of circumferentially spaced ratchet teeth are molded at the free end of the tamper indicating band. The closure is a threaded cap having a top and a skirt depending from the top. A circumferential array of ratchet teeth are located at the lower end of the cap skirt so that when the cap is affixed to the container neck at least one of the ratchet teeth on the band will engage a ratchet tooth on the cap to prevent removal of the cap from the container without fracture of the frangible webs which indicates tampering or initial opening of the cap on the container neck. Both the cap and tamper indicating band ratchet teeth have ramp surfaces which permit the cap ratchet teeth to pass in sliding contact with the band ratchet teeth moving the band ratchet teeth axially away from the cap ratchet teeth as the cap is being threaded onto the container neck. Each of the cap and band ratchet teeth have stop surfaces which engage to prevent unthreading of the cap without fracture of the frangible webs.

In one embodiment the ratchet teeth are fixed and the frangible webs are flexible to permit movement of the band toward the container neck flange providing the movement of the band ratchet teeth axially away from the cap ratchet teeth.

In a preferred form of the invention, the band ratchet teeth are in the form of pawls which pivot relative to the band as the cap ratchet teeth make contact in threading the cap onto the container neck. These pawls can be resilient fingers which extend at an angle upwardly from the top of the band in a clockwise direction when viewed above to provide the necessary combination of ramp and stop surfaces.

In a preferred embodiment the free end of the tamper indicating band is molded with two pairs of diametrically opposed circumferentially spaced ratchet teeth or pawls. When unthreading torque is applied to the cap, at least one of the pairs of ratchet teeth on the band will engage ratchet teeth on the cap to prevent unthreading from the container neck without fracture of the frangible webs. With this design, the cap is provided with an even number of ratchet teeth and one of the opposed pair of ratchet teeth on the tamper indicating band is spaced from the other pair of diametrically opposed ratchet teeth by an angle of 90° plus or minus one-half the pitch of the ratchet teeth on the cap to assure that one of these opposed pairs of ratchet teeth on the tamper indicating band engages teeth on the cap.

In a preferred form of the invention, the cap ratchet teeth are contained within a recess formed by a wall portion of the cap skirt and this wall portion overlaps the tamper indicating band when the cap has been affixed to the container neck so that the band ratchet teeth or pawls and the cap ratchet teeth are not visible. This not only adds to the aesthetic appearance of the package, but is a further deterrent to attempts to defeat the tamper indicating feature.

In another preferred embodiment of the invention, the tamper indicating band is discontinuous so that it presents space ends of the band which are substantially opposed to each other. A lug extends axially upward from the container neck flange between the opposed band ends. When the cap is threaded onto the container neck, the downstream end of the band in the threading direction will be pushed into contact with the lug by the contact of the cap ratchet teeth with the band ratchet teeth or pawls further assuring that the frangible webs will not fracture during the capping operation. When unthreading torque is applied to the cap, the lug deflects the upstream end of the band outwardly as the webs are being fractured.

Further advantages of this invention are depicted in the embodiments disclosed in the following description and illustrated in the drawing in which.

Figure 4:
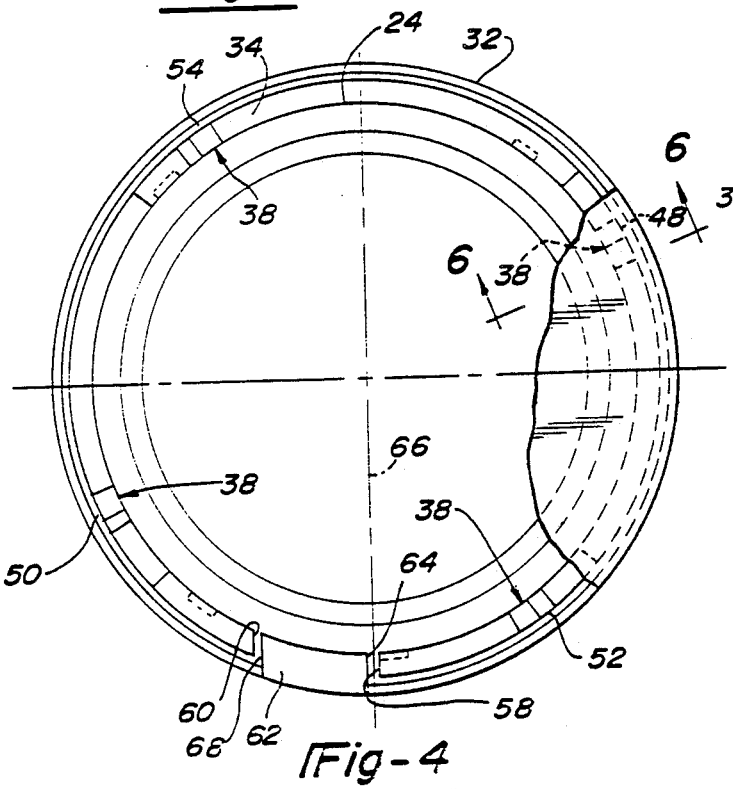
FIG. 4 is a top plan view with a partial cut-away of the container of FIGS. 1 and 3 taken along line 4—4 in FIG. 3.
Figure 6:
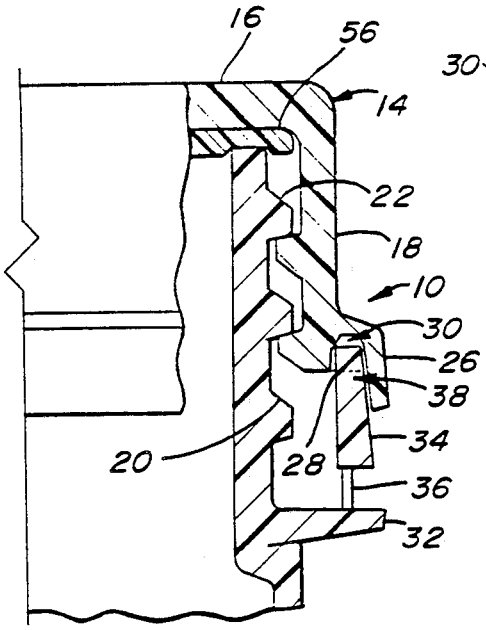
Figure 7:
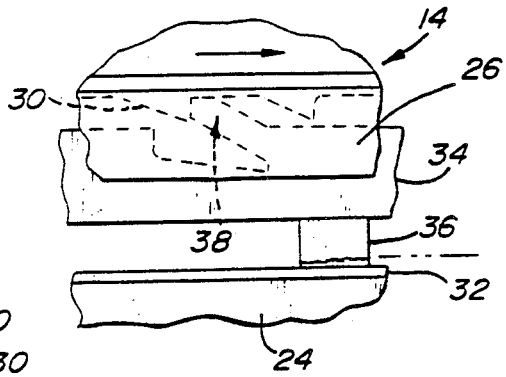
Figure 8:
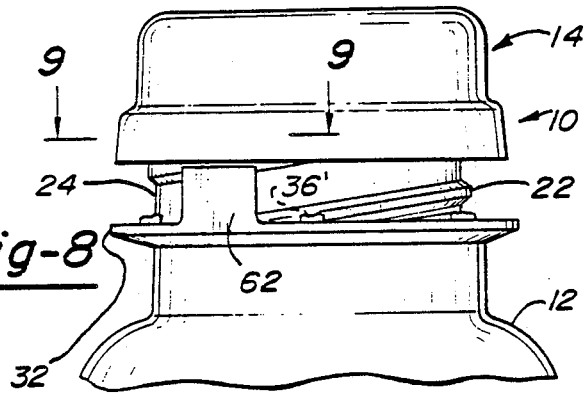
Figure 9:
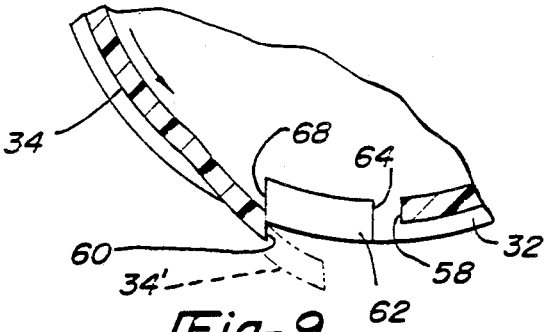
Figure 10:
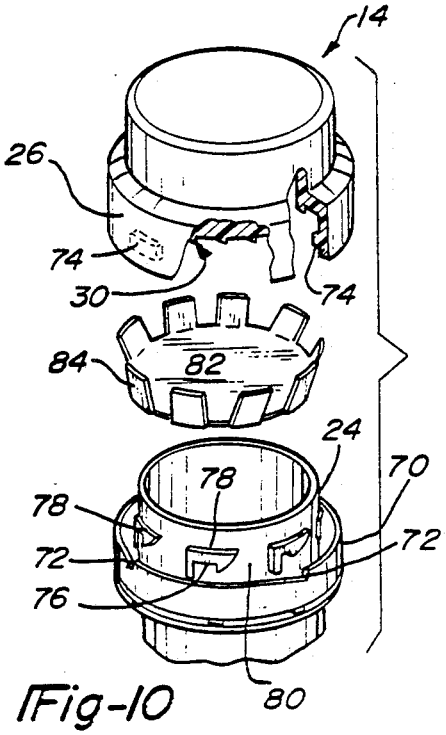

FIG. 6 is a partial cross-sectional elevational view taken along line 6—6 of FIG. 4 of the container-closure package of the invention showing the closure cap in full engagement with the container neck with the ratchet teeth or pawls at the top of the tamper indicating band in engagement with the cap ratchet teeth which are located in a recess of a skirt wall portion which also overlaps the cap and band ratchet teeth;

FIG. 7 is a partial elevational view showing the overlap of the skirt wall portion of the closure with the tamper indicating band with one of the pawls on the band in full engagement with one of the ratchet teeth on the cap as the cap is being unthreaded in the direction of the arrow by the application of a twisting torque;

FIG. 8 is an elevational view of the container-closure package of the invention after the tamper indicating band has been broken away from the container neck flange;

FIG. 9 is a partial cross-sectional plan view taken along 9—9 of FIG. 8 showing the camming of the upstream end of the tamper indicating band off the container neck flange by the container neck lug as the frangible webs are being broken; and FIG. 10 is an exploded perspective view of another embodiment of the invention in which a tamper indicating band is circumferentially continuous and the closure attachment means takes the form of bayonet-type multi-start threads.

Referring to the drawing, the tamper indicating package 10 of the invention is shown as including container 12 and closure 14. The closure 14 takes the form of a standard type cap having a substantially planar top 16 and an annular skirt 18 depending from the periphery of the top 16. Cap skirt 18 contains internal threads 20, see FIG. 6, which engage external threads 22 on the container neck 24. Cap skirt 18 has an outwardly flared wall portion 26 at its lower end which defines a recess 28 which houses or contains a circumferential array of equally spaced ratchet teeth 30. For example, there can be 24 ratchet teeth that are equally spaced at 15° apart.

Figure 1:
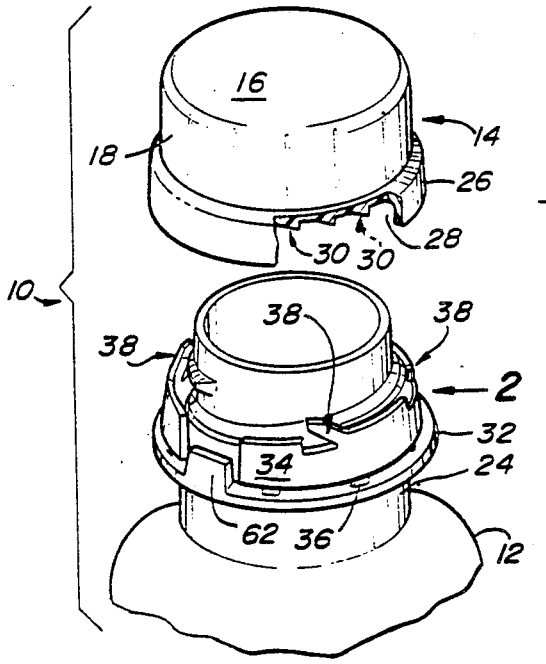
FIG. 1 is an exploded perspective view of the package of this invention showing the tamper indicating band molded integrally with the container neck and showing the details of the pawls located at the top of the tamper indicating band and the annular array of ratchet teeth located on the lower end of the cap skirt.
Figure 2:
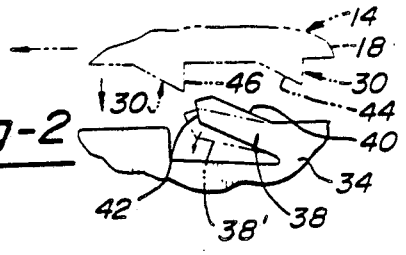
FIG. 2 is a fragmentary view looking in the direction of line 2 in FIG. 1 showing the co-action of one of the pawls on the tamper indicating band with the ratchet teeth on the cap.
Figure 3:
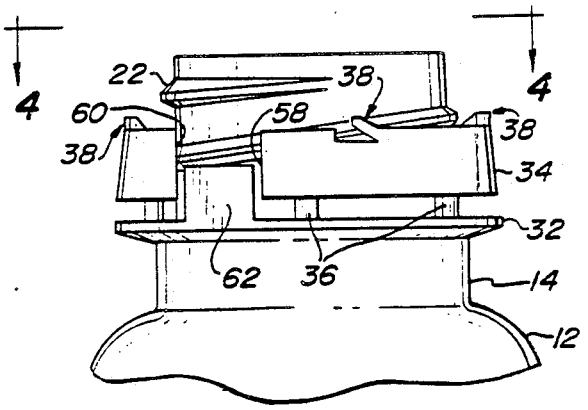
FIG. 3 is an elevational view of the container of FIG. 1 showing further details of the construction.
Figure 5:
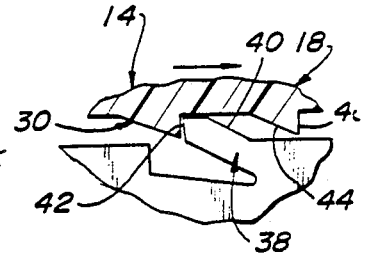
FIG. 5 is a fragmentary view similar to FIG. 2 with the ratchet teeth of the cap in cross-section showing engagement of one of the cap ratchet teeth with a pawl on the tamper indicating band as unthreading torque is applied to the cap.

Container neck 24 is provided with an integrally molded outwardly extending flange 32 below the container neck threads 22. Tamper indicating band 34 is integrally molded with the container 12 being attached to the neck flange 32 by a plurality of equally spaced frangible webs 36. Ratchet teeth or pawls 38 are located at the top of the tamper indicating band, and in the embodiments shown in FIGS. 1, 2, 3, 5 and 7 these take the form of four pivotable pawls extending in the upstream direction of unthreading of the cap 14. Referring specifically to FIGS. 2 and 5, it can be seen that each pawl has an upper cam or ramp surface 40 and a axially extending stop surface 42. Similarly the cap ratchet teeth 30 have a cam or ramp surface 44 and an axially extending stop surface 46.

As the cap 14 is threaded onto the container neck 24 the cam or ramp surface 44 of cap ratchet teeth 30 contact the cam surface 40 of the pawls 38 pressing them in the direction of the arrow shown in FIG. 2 to a position 38' as they pass by. When unthreading torque is applied to the cap 14, the stop surface 42 of at least one of the pawls 38 will engage the stop surface 46 on at least one of the cap ratchet teeth 30 as shown in FIG. 5 preventing further rotation of cap 14 so that continuing application of turning torque will cause the frangible webs 36 to fail in shear as shown in FIG. 7.

Referring to FIG. 4, in a preferred form of the invention the individual pawls 38 are arranged in two diametrically opposed pairs of pawls 48, 50 and 52, 54. An equal number of cap ratchet teeth 30 are provided as a multiple of the number of ratchet teeth or pawls 38 on the tamper indicating band. The opposed pair of pawls 48, 50 is offset from the adjacent diametrically opposed pair of pawls 52, 54 respectively by a function of this multiple plus or minus one-half of the pitch of the cap ratchet teeth so that only one pair of opposed pawls 48, 50 or pawls 52, 54 would be in contact with corresponding ratchet teeth 30, thus assuring that there is always a pair of pawls 38 in engagement with the cap ratchet teeth 30 when unthreading torque is applied to the cap. In the previously mentioned example where there are 24 equally spaced ratchet teeth 30 at 15° from each other, pawl 52 would be located at 82.5° from pawl 48 and pawl 54 would also be located at 82.5° from pawl 54.

As most clearly seen in FIG. 6 with the ratchet teeth 30 located in the recess 28 formed by the outwardly flared skirt wall portion 26, and with the overlap of this wall portion 26 with the tamper indicating band 34, the engagement of the cap ratchet teeth 30 with the tamper indicating band ratchet teeth or pawls 38 are completely hidden from sight so that the retention mechanism is not visible to a person contemplating tampering.

It may also be observed in FIG. 6 that with the use of a large number of ratchet teeth on the cap, the seal effected by a resilient gasket 56 will remain intact from a fully tightened position of cap 14 to the engagement of at least one of the tamper indicating band pawls 38 with a ratchet tooth 30 for shearing the web 36 to indicate initial opening or tampering with the container.

As best seen in FIGS. 1, 3, 4 and 9, the tamper indicating band 34 is discontinuous so as to present spaced opposed ends 58 and 60. Between these spaced ends 58 and 60 is an upwardly projecting tooth or lug 62 molded integrally with the outwardly extending container neck flange 32. The end face 58 of the tamper indicating band and the opposing face 64 of the lug 62 are parallel to diametric line 66 so that when the cap 14 is threaded onto the container neck 24 these two opposed surfaces 58 and 64 will come into full abutment with each other to prevent further twisting of the band thus assuring that the frangible webs 36 will not be fractured. That is, the downstream end 58 (in the direction of unthreading) is in full contact with the opposed adjacent face 64 of the lug 62. When unthreading torque is applied to the cap 14 in the direction of the arrows shown in FIGS. 5 and 7, the upstream end of the band 60 in the direction of unthreading will contact the opposed adjacent face 68 of the lug 62 to cam the band outwardly as shown at 34' in FIG. 9 as the frangible webs are fractured. To assure this camming action, the band end face 60 and the opposed lug face 68 are disposed parallel to diametric line 66 as most clearly seen in FIG. 4.

FIG. 8 shows the container-closure package 10 after the tamper indicating band 34 has been removed by fracture of the frangible webs 36. Only a small almost non-discernable portion 36' of the frangible webs remain on the container neck flange 32.

In the embodiment of the invention shown in FIG. 10, the tamper indicating band 70 is shown as being a circumferentially continuous ring. Also the pawls 72 at the top of the tamper indicating band 70 are shown in the form of rigid or fixed ratchet teeth. The downward movement of teeth 72 relative to the cap ratchet teeth 30 when the cap is being applied to the container neck is effected through the flexibility of the frangible webs 36.

FIG. 10 also shows that the closure attachment means can take the form of a modified type of thread such as a multi-start thread of the bayonet type wherein inwardly extending lugs 74 on cap 14 engage recesses 76 in ramps 78 on container neck 24. With multi-start or jump threads the cap can be affixed to the container neck by an axial movement without the conventional rotational threading. In the case of a bayonet type of thread connection, the cap lugs 74 must first be aligned with spaces 80 between adjacent neck ramps 78 before a downward or axial motion is imparted to the cap followed by a small rotational turn to secure the lugs 74 in the ramp recesses 76. Resilient member 82 with fingers 84 apply an upward biasing force to cap 14.

It will be readily apparent from the variety of closure attachment means shown with the various embodiments that the ratchet locking mechanism of the invention will function between the tamper indicating band on the container and a cap normally requiring a twist to disengage it from the container. The "cap" member carrying the ratchet teeth does not necessarily have to be a threaded member. For example, the Easy-Lok line of closures manufactured by the Sunbeam Plastic Corporation are two piece child resistant closures in which an inner cap screws onto a container neck and an over cap must be manipulated to engage the inner cap for unthreading. The "cap" ratchet teeth can be on the unthreaded over cap. This type of child resistant driven inner cap and driver over cap is shown is U.S. Pat. Nos. 3,679,085; 3,685,676; 3,705,662; 3,722,727; 3,830,390; and 4,353,474.

We claim:

1. A tamper indicating container-closure package comprising, in combination:
   - a container having a neck with means for attaching a closure thereto;
   - an outwardly extending flange on said neck below said closure attachment means;
   - a tamper indicating band circumposing said neck and attached to said flange by a plurality of circumferentially spaced frangible webs;
   - a plurality of circumferentially spaced ratchet teeth on the free end of said band;
   - a closure cap having a top and a skirt depending from said top with attachment means complementary to said container attaching means; and
   - a circumferential array of ratchet teeth at the lower end of said cap skirt;
   - whereby when said cap is affixed to said container neck by said attachment means, at least one of said teeth on said band will engage a ratchet tooth on said cap to prevent removal of said cap from said container neck without fracture of said frangible webs thereby indicating tampering or initial opening of said cap on said container neck.

2. The container-closure package according to claim 1 wherein said container and closure attachment means are threads.

3. The closure attachment means according to claim 2 wherein said threads are helical threads extending around said container neck and closure cap more than 360°.

4. The container-closure package according to claim 2 wherein said threads are a plurality of multi-start threads on said container neck and closure cap.

5. The container-closure package according to claim 4 wherein said threads are of the bayonet type with inwardly extending lugs on the cap engaging recesses in ramps on said container neck.

6. A tamper indicating container-closure package comprising, in combination:
   - a container having a threaded neck;
   - an outwardly extending flange on said neck below said threads;
   - a tamper indicating band circumposing said neck and attached to said flange by a plurality of circumferentially spaced frangible webs;
   - a plurality of circumferentially spaced ratchet teeth on the free end of said band;
   - a closure cap having a top and a skirt depending from said top with threads for engagement with said container neck threads; and
   - a circumferential array of equally spaced ratchet teeth at the lower end of said cap skirt;
   - whereby when said cap is affixed to said container neck and unthreading torque is applied to said cap, at least one of said teeth on said band will engage a ratchet tooth on said cap to prevent unthreading of said cap from said container neck without fracture of said frangible webs thereby indicating tampering or initial opening of said cap on said container neck.

7. The container-closure package according to claim 6 wherein each of said cap and band ratchet teeth have ramp surfaces permitting the cap ratchet teeth to pass in sliding contact with the band ratchet teeth moving said band ratchet teeth axially away from said cap ratchet teeth as the cap is being threaded onto said container neck, and each of said cap and band ratchet teeth have stop surfaces which engage to prevent unthreading of said cap without fracture of said frangible webs.

8. The container-closure package according to claim 7 wherein the ratchet teeth on said band are fixed and said frangible webs are flexible permitting movement of said band toward said container neck flange.

9. The container-closure package according to claim 7 wherein said band ratchet teeth are in the form of pawls which pivot relative to said band as the cap ratchet teeth make contact when the cap is being threaded onto said container neck.

10. The container-closure package according to claim 9 wherein each of said pawls includes a finger extending at an angle upwardly from the top of said band in a clockwise direction when viewed from above.

11. A tamper indicating container-closure package comprising, in combination:

a container having a threaded neck;

an outwardly extending flange on said neck below the threaded portion of said neck;

a tamper indicating band circumposing said neck and attached to said flange by a plurality of circumferentially spaced frangible webs;

a plurality of pairs of diametrically opposed circumferentially spaced ratchet teeth on the free end of said band;

a closure cap having a top and a skirt depending from said top with threads for engagement with said container neck threads; and a plurality of equally spaced ratchet teeth at the lower end of said cap skirt;

whereby when said cap is affixed to said container neck, and unthreading torque is applied to said cap, at least one of said pairs of ratchet teeth on said band will engage ratchet teeth on said cap to prevent unthreading from said container neck without fracture of said frangible webs, thereby indicating tampering or initial opening of said cap on said container neck.

12. The container-closure package according to claim 11 wherein said cap has an even number of ratchet teeth and a first pair of diametrically opposed ratchet teeth on said band is circumferentially spaced from a second pair of diametrically opposed ratchet teeth by 90° plus or minus one-half the pitch of the ratchet teeth on said cap whereby one of said first and second pairs of opposed ratchet teeth on said band will engage ratchet teeth on said cap as unthreading torque is applied to said cap.

13. The container-closure package according to claim 11 wherein said band ratchet teeth are in the form of pawls which pivot relative to said band as said cap ratchet teeth make contact when the cap is being affixed to said container neck.

14. The container-closure package according to claim 13 wherein said cap ratchet teeth are contained within a recess formed by a wall portion of said cap skirt and said wall portion overlaps said tamper indicating band and said pawls so that said cap ratchet teeth and pawls are not visible when said cap has been affixed to said container neck.

15. A tamper indicating container-closure package comprising, in combination:

a container having a threaded neck;

an outwardly extending flange on said neck below the threaded portion of said neck;

a tamper indicating band circumposing said neck and attached to said flange by a plurality of circumferentially spaced frangible webs, said band being discontinuous, presenting spaced ends which are substantially opposed to each other;

a plurality of circumferentially spaced pawls on the free end of said band;

a closure cap having a top and a skirt depending from said top with threads for engagement with said container neck threads;

a plurality of equally spaced teeth at the lower end of said cap skirt; and a lug extending axially from said container neck flange between said opposed band ends;

whereby when said cap is threaded onto said container neck, the downstream end of the band in the threading direction will be pushed into contact with said lug by the contact of the cap ratchet teeth with said pawls, preventing fracture of said frangible webs, and when unthreading torque is applied to said cap, at least one of said pawls will engage a ratchet tooth on said cap to prevent unthreading from said container neck without fracture of said frangible webs, thereby indicating tampering or initial opening of said cap on said container neck, said lug deflecting outwardly the upstream end of said band in the unthreading direction as said webs are fractured.

16. The container-closure package according to claim 15 wherein the downstream end of the band in the threading on direction and an opposing side of said lug are closely spaced and are substantially on a diametric line of said cap so that when the cap is being threaded onto the container neck, the downstream end of the band will abut the opposing side of said lug.

17. The container-closure package according to claim 16 wherein the upstream end of said band in the unthreading direction and an adjacent side of said lug have faces which are parallel to said diametric line so that when unthreading torque is applied to said cap said faces will contact each other to cam the upstream end of the band outwardly as said frangible webs are fractured.

18. A tamper indicating container-closure package comprising, in combination:

a container having a threaded neck;

an outwardly extending flange on said neck below said threads;

a tamper indicating band circumposing said neck and attached to said flange by a plurality of circumferentially spaced frangible webs;

a plurality of pawls on the free end of said band;

a closure cap having a top and a skirt depending from said top with threads for engagement with said container neck threads; and a circumferential array of equally spaced ratchet teeth contained within a recess formed by a wall portion of said cap skirt;

whereby when said cap is affixed to said container neck said wall portion of said cap skirt overlaps said tamper indicating band and said pawls so that said cap ratchet teeth and pawls are not visible, and when unthreading torque is applied to said cap, at least one of said teeth on said band will engage a ratchet tooth on said cap to prevent unthreading of said cap from said container neck without fracture of said frangible webs thereby indicating tampering or initial opening of said cap on said container neck.

19. A tamper indicating container for use with a threaded closure cap having a top and a depending skirt with an annular array of spaced ratchet teeth extending away from said top, said container comprising:

a threaded neck;

an outwardly extending flange on said neck below said threads;

a tamper indicating band circumposing said neck and attached to said flange by a plurality of circumferentially spaced frangible webs; and a plurality of spaced pawls on the free end of said band;

whereby when a cap is affixed to said container neck and unthreading torque is applied to said cap, at least one of said pawls will engage a ratchet tooth on said cap to prevent unthreading of said cap from said container neck without fracture of said frangible webs thereby indicating tampering or initial opening of said cap on said container neck.

* * * * *